US008099905B2

(12) United States Patent
Sasaki et al.

(10) Patent No.: US 8,099,905 B2
(45) Date of Patent: Jan. 24, 2012

(54) WINDOW REGULATOR

(75) Inventors: Kazuyuki Sasaki, Yokohama (JP); Ryoji Shimura, Yokohama (JP); Yasunori Nakajima, Yokohama (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 708 days.

(21) Appl. No.: 12/204,285

(22) Filed: Sep. 4, 2008

(65) Prior Publication Data

US 2009/0064590 A1 Mar. 12, 2009

(30) Foreign Application Priority Data

Sep. 7, 2007 (JP) ..... 2007-232626

(51) Int. Cl.
*E05F 11/48* (2006.01)

(52) U.S. Cl. ..... 49/352

(58) Field of Classification Search ..... 49/348, 49/349, 352, 372, 375
See application file for complete search history.

(56) References Cited

U.S. PATENT DOCUMENTS

| | | | | |
|---|---|---|---|---|
| 4,829,711 | A * | 5/1989 | Sambor | 49/211 |
| 5,022,184 | A * | 6/1991 | Yamamura et al. | 49/352 |
| 5,058,322 | A * | 10/1991 | Sambor | 49/352 |
| 5,528,861 | A * | 6/1996 | Beyerlein | 49/352 |
| 6,874,279 | B1 * | 4/2005 | Weber et al. | 49/352 |
| 7,617,633 | B2 * | 11/2009 | Shimura et al. | 49/349 |
| 2004/0237410 | A1 * | 12/2004 | Cardine et al. | 49/352 |
| 2007/0017159 | A1 * | 1/2007 | Moore | 49/502 |
| 2009/0007495 | A1 * | 1/2009 | Smith | 49/352 |

FOREIGN PATENT DOCUMENTS

| | | | |
|---|---|---|---|
| DE | 4002274 | A1 * | 8/1991 |
| JP | 2-217582 | A | 8/1990 |
| JP | 06-45031 | | 11/1994 |

* cited by examiner

*Primary Examiner* — Jerry Redman
(74) *Attorney, Agent, or Firm* — Foley & Lardner LLP

(57) ABSTRACT

A window regulator includes a carrier member to which a window panel is attached, a pair of sliding elements provided on the carrier member, and a positioning unit which relatively positions the pair of sliding elements in a state where the pair of sliding elements press the guide rail and the pair of sliding elements sandwich the guide rail.

10 Claims, 8 Drawing Sheets

WINDOW REGULATOR

CROSS REFERENCE TO RELATED APPLICATION

This application is based upon and claims the benefit of priority from prior Japanese Patent Application P2007-232626, filed on Sep. 7, 2007; the entire contents of which are incorporated by reference herein.

BACKGROUND OF THE INVENTION

1. Field of the Invention

The present invention relates to a window regulator, and, more particularly relates to a window regulator which vertically moves or opens and closes a window panel provided in an automobile and the like.

2. Description of the Related Art

A window regulator is used for vertically moving a window panel (window glass) attached to a door of an automobile. The window regulator includes a guide rail which has a vertical slide direction in the door, and a carrier plate which slides on the guide rail. The window panel is attached to the carrier plate.

In the window regulator of this kind, play (clearance) is provided at a fitted portion between the guide rail and the carrier plate to absorb variation in plate thickness of the guide rail and a mounting error of the door. The play produces rattles between the guide rail and the carrier plate, and therefore between the door body and the window panel when the door is opened or closed, or the automobile runs. Japanese Utility Model Publication No. H6-45031 discloses a technique in which an elastic member is provided in a sliding portion between the guide rail and the carrier plate, thereby preventing rattles between the door body and the window panel caused by play of the sliding portion.

SUMMARY OF THE INVENTION

In the window regulator, however, the following point is not taken into account. That is, when a high load is applied in a longitudinal direction of an automobile because of a factor such as hard braking, the elastic member is easily bent. As a result, play is instantaneously generated between the guide rail and the carrier plate of the window regulator, and accordingly, rattles are generated in the window panel with respect to the door.

It is therefore an object of the present invention to provide a window regulator capable of reducing rattles of a sliding portion between a guide rail and a carrier member.

A first aspect of the present invention provides a window regulator comprising: a carrier member to which a window panel is attached; a pair of sliding elements which are provided on the carrier member, which sandwich a guide rail, and which can slide on the guide rail; and a positioning unit which relatively positions the pair of sliding elements in a state where the pair of sliding elements press the guide rail and the pair of sliding elements sandwich the guide rail.

According to a second aspect of the present invention, in the window regulator according to the first aspect, the carrier member includes a connecting plate to which the window panel is attached, a carrier body which is connected to the connecting plate and to which one of the pair of sliding elements is fixed, and an adjusting plate which is located between the connecting plate and the carrier body and to which the other of the pair of sliding elements is fixed, and the positioning unit includes a position adjusting bolt provided on the carrier body, a position adjusting hole which is formed in the adjusting plate, into which the position adjusting bolt is inserted, and in which the adjusting plate can move toward the guide rail with respect to the inserted position adjusting bolt, and a nut which is threadably engaged with the position adjusting bolt passing through the position adjusting hole, and which mounts the adjusting plate on the carrier body.

According to a third aspect of the present invention, in the window regulator according to the first aspect, the carrier member includes the connecting plate to which the window panel is attached and to which one of the pair of sliding elements is fixed, and a carrier body which is connected to the connecting plate and to which the other of the pair of sliding elements is fixed, and the positioning unit includes a position adjusting bolt provided on the carrier body, a position adjusting hole which is formed in the connecting plate, into which the position adjusting bolt is inserted, and in which the adjusting plate can move toward the guide rail with respect to the inserted position adjusting bolt, and a nut which is threadably engaged with the position adjusting bolt passing through the position adjusting hole, and which mounts the adjusting plate on the carrier body.

According to a fourth aspect of the present invention, in the window regulator according to one of the first to third aspects, the positioning unit relatively positions the pair of sliding elements in a state where the sliding elements are pressed against the guide rail by an assembling device and the sliding elements sandwich the guide rail.

According to a fifth aspect of the present invention, in the window regulator according to one of the first to third aspects, the positioning unit includes a screw-type pressing mechanism which presses one of the pair of sliding elements against the guide rail.

According to a sixth aspect of the present invention, in the window regulator according to one of the first to third aspects, the positioning unit includes an eccentric cam-type pressing mechanism which presses one of the pair of sliding elements against the guide rail.

According to a seventh aspect of the present invention, in the window regulator according to the first aspect, the carrier member includes a connecting plate to which the window panel is attached, and a carrier body which is connected to the connecting plate and to which one of the pair of sliding elements is fixed, the carrier body has an accommodation recess formed on an opposite side from a location where the guide rail is attached, and the connecting plate covers the accommodation recess in a state where corresponding terminal members of opposite ends of a wire for moving the carrier member along the guide rail are accommodated in the accommodation recess to maintain the accommodation. The connecting plate may cover the accommodation recess directly or through another member.

DETAILED DESCRIPTION OF THE PREFERRED EMBODIMENTS

Figure 1:
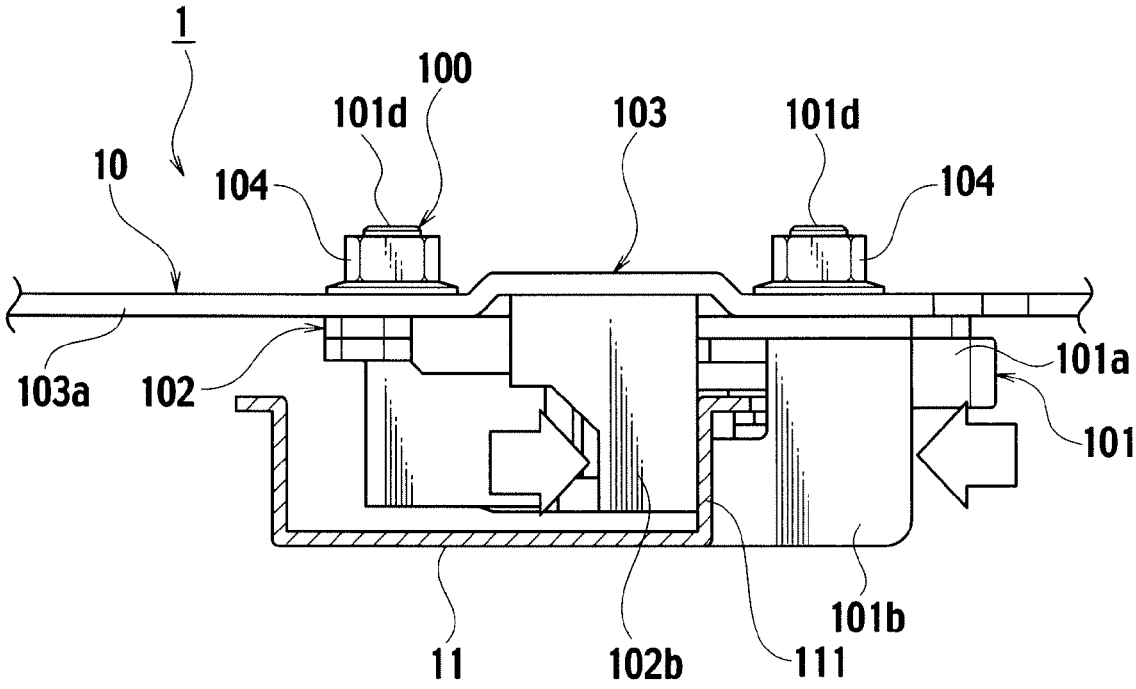
FIG. 1 is a sectional view of relevant parts of a window regulator according to a first embodiment of the present invention.

Embodiments of the present invention are explained below with reference to the accompanying drawings. The embodiments shown below are examples of a window regulator to be used for a power window of an automobile, to which the present invention is applied. In the embodiments, like constituent elements are denoted by like reference numerals, and redundant explanations will be omitted.

First Embodiment

Figure 4:
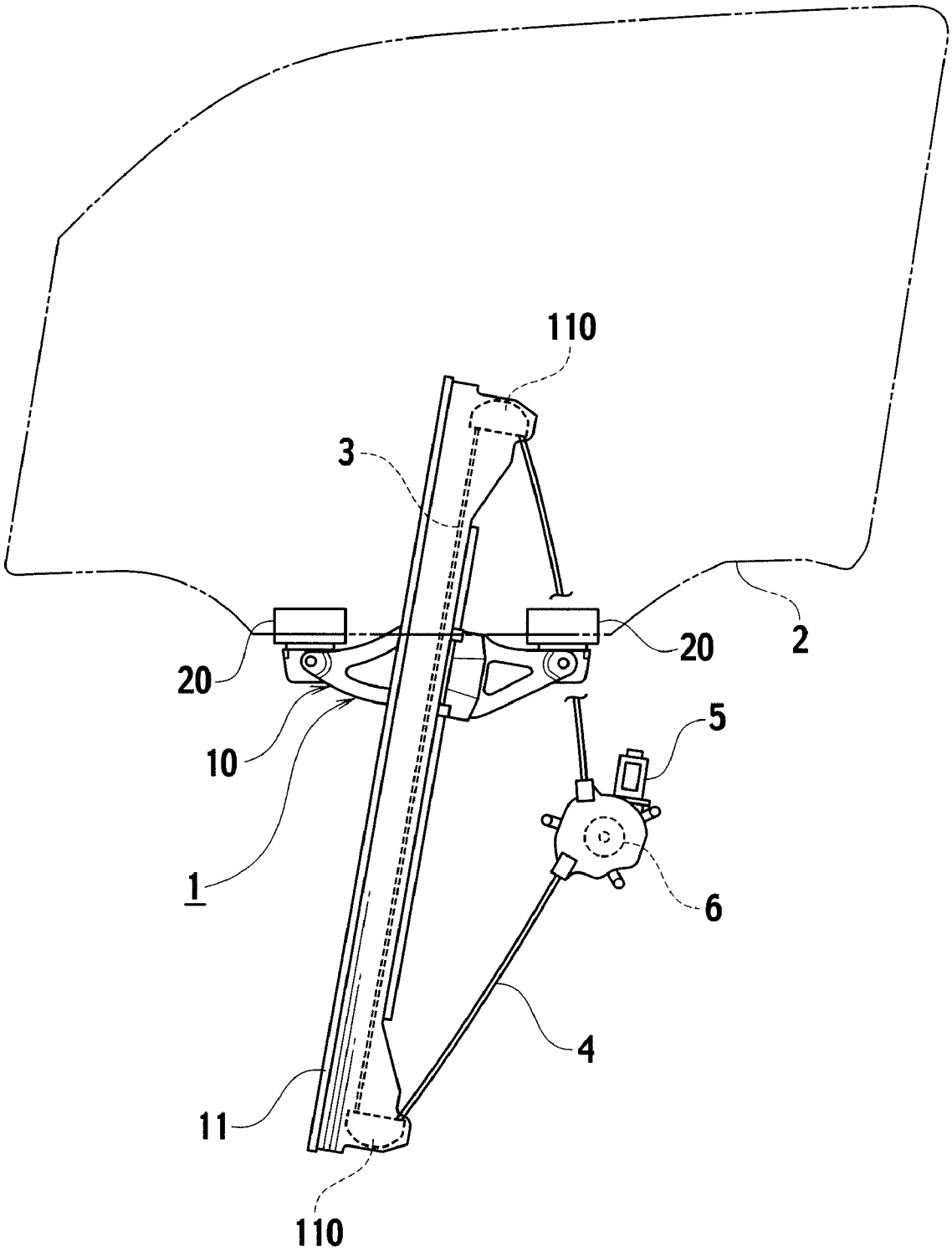
FIG. 4 is a schematic diagram showing a structure of a vehicular door that is mounted with the window regulator shown in FIG. 1.

As shown in FIG. 4, a window regulator 1 mounted on a door (not shown) of a vehicle such as an automobile includes a carrier member 10 to which a window panel (window glass) 2 is attached, and a guide rail 11 which vertically guides the carrier member 10.

The guide rail 11 is slightly inclined rearward and placed in the door, and is fixed to the door through a bracket (not shown). Except opposite ends of the guide rail 11 (in other words, except upper and lower ends of the guide rail 11 in a state where the guide rail is mounted on the door), the cross section of the guide rail 11 has a hat-like shape, as shown in FIG. 1. Semi-circular guide portions 110 are mounted on the opposite ends of the guide rail 11, respectively.

One end of a wire 3 is connected to the carrier member 10. The other end of the wire 3 is routed to one end of the guide rail 11, and is hung around one of the guide portions 110, and is further wound around a drum 6 mounted on a central portion of the guide rail 11 in its longitudinal direction. The other end of the wire 3 is hung around the other guide portion 110 on the other end of the guide rail 11, and is connected to the carrier member 10 from the other end of the guide rail 11. The wire 3 is covered and protected with an outer tube 4 behind the guide rail 11. A motor 5 is connected to a rotation shaft of the drum 6, and when the motor 5 rotates, the drum 6 rotates. By rotating the drum 6 by the motor 5, the wire 3 is supplied and discharged, and thus the carrier member 10 moves along the guide rail 11.

The window panel 2 is mounted on the carrier member 10 through holders 20. That is, when the carrier member 10 vertically moves along the guide rail 11, the window panel 2 vertically moves.

Figure 2:
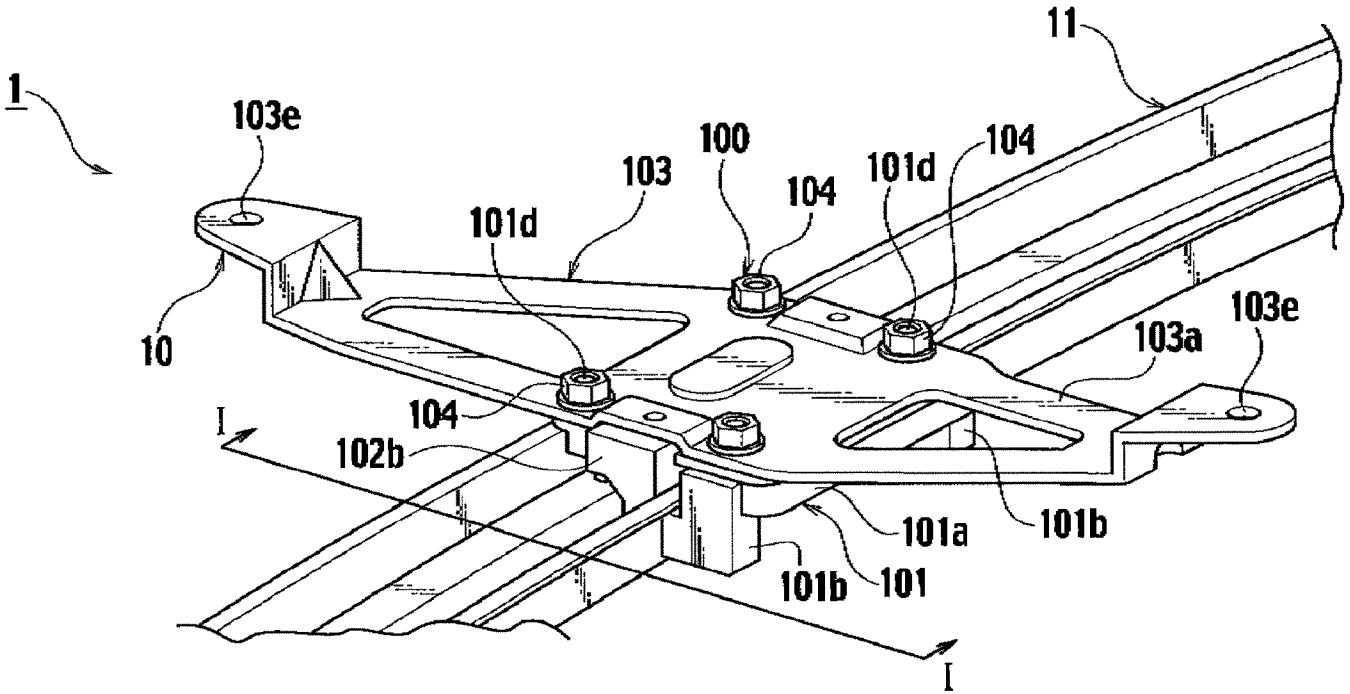
FIG. 2 is a perspective view of the relevant parts of the window regulator shown in FIG. 1.
Figure 3:
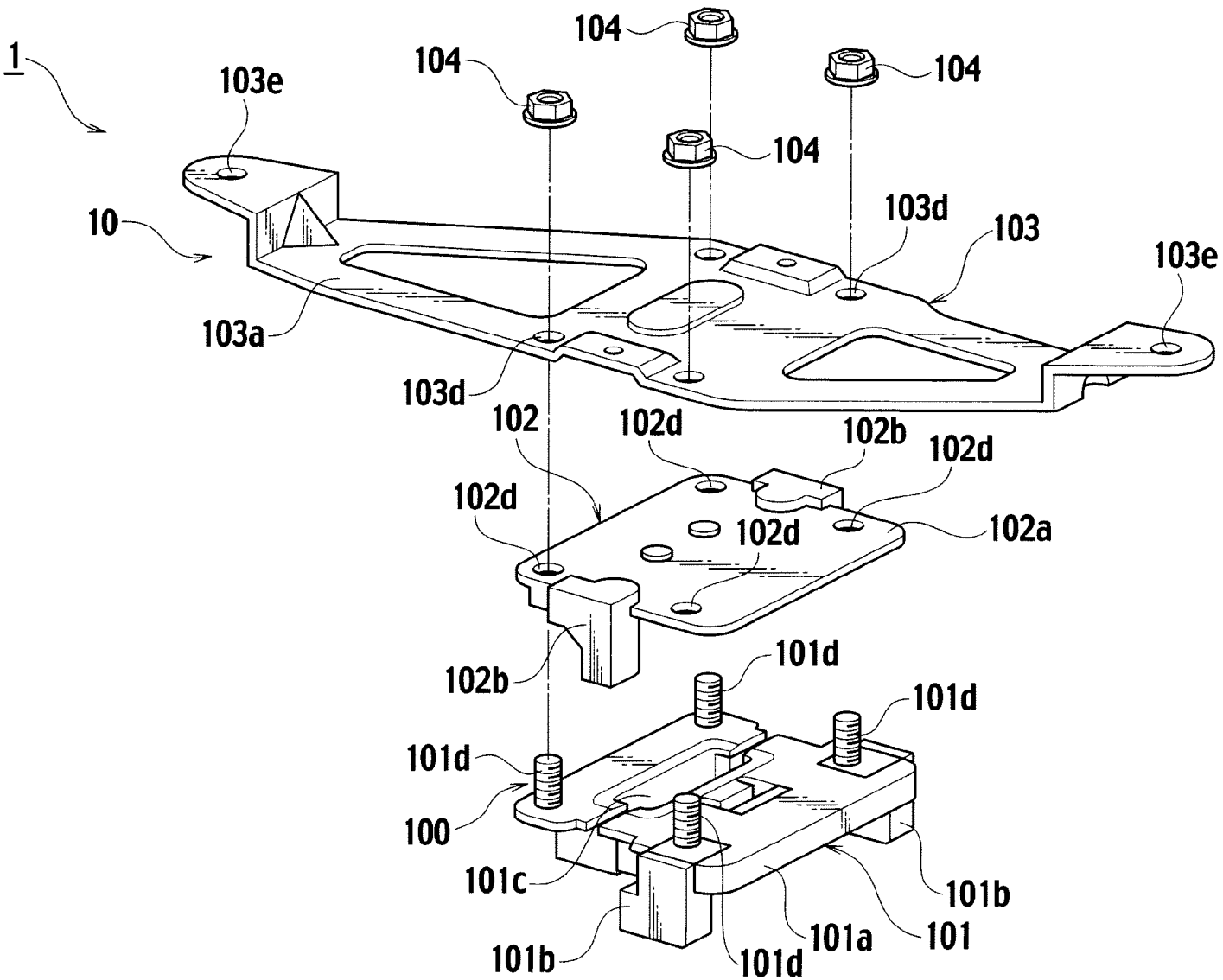
FIG. 3 is an exploded perspective view of a carrier member of the window regulator shown in FIG. 1.

As shown in FIGS. 1 to 3, the carrier member 10 includes a connecting plate 103 on which the window panel 2 is directly mounted through the holders 20, a carrier body 101 connected to the connecting plate 103, and an adjusting plate 102 located between the connecting plate 103 and the carrier body 101. The carrier member 10 includes pairs of first sliding elements 101*b* and second sliding elements 102*b*, and a positioning unit 100 which relatively positions the first sliding elements 101*b* and the second sliding elements 102*b*. The positioning unit 100 pushes the first sliding element 101*b* and the second sliding element 102*b* against the guide rail 11, and relatively positions the first sliding element 101*b* and the second sliding element 102*b* in a state where the first sliding element 101*b* and the second sliding element 102*b* sandwich the guide rail 11.

The carrier body 101 includes a steel board 101*a*, the first sliding elements 101*b* which are ones of the pairs of sliding elements, and an accommodation recess 101*c*. The first sliding elements 101*b* are placed in contact with a vertical wall 111 of the guide rail 11, and slide along the vertical wall 111 in its longitudinal direction. The first sliding element 101*b* is made of synthetic resin for example, and is mounted on the board 101*a* by outsert molding. The two first sliding elements 101*b* are located on opposite sides of the carrier body 101 in the sliding direction. The accommodation recess 101*c* accommodates terminal members (not shown) of opposite ends of the wire (cable) 3. The accommodation recess 101*c* is made of synthetic resin for example, and is mounted on the board 101*a* by outsert molding, like the first sliding elements 101*b*. Position adjusting bolts 101*d* of the positioning unit 100 are embedded in four corners of the board 101*a*. Each of the position adjusting bolts 101*d* fastens the adjusting plate 102 and the connecting plate 103 to the carrier body 101. The position adjusting bolts 101*d* enable the first sliding element 101*b* and the second sliding element 102*b* to sandwich the vertical wall 111 of the guide rail 11 being pressed by and between the first sliding element 101*b* and the second sliding element 102*b*.

The adjusting plate 102 includes a steel board 102*a*, and the second sliding elements 102*b*, which are the others of the pairs of sliding elements. The second sliding elements 102*b* are in contact with the vertical wall 111 of the guide rail 11, and sandwich the vertical wall 111 together with the first sliding elements 101*b*. The second sliding elements 102*b* slide on the vertical wall 111 along the longitudinal direction of the vertical wall 111. The second sliding element 102*b* is made of synthetic resin for example, and is mounted on the board 102*a* by outsert molding, like the first sliding element 101*b*. The two second sliding elements 102*b* are located on opposite sides of the adjusting plate 102 in its sliding direction. Position adjusting holes 102*d* of the positioning unit 100 are formed in four corners of the board 102*a* at locations corresponding to the position adjusting bolts 101*d*. The position adjusting holes 102*d* are through holes penetrating the board 102*a*. Each of the position adjusting holes 102*d* is a long hole having quite a large diameter as compared with at least an outside size of the position adjusting bolt 101*d* in a direction orthogonal to the sliding direction of the second sliding element 102*b*, more specifically in a direction perpendicular to the surface of the vertical wall 111. The position adjusting bolts 101*d* are inserted through the position adjusting holes 102*d*. Each position adjusting hole 102*d* is formed such that the adjusting plate 102 can move toward the guide rail 11 with respect to the inserted position adjusting bolt 101*d*. In the first embodiment, it is not always necessary that the position adjusting hole 102*d* is a long hole, and may be a circular or elliptic hole so that the second sliding element 102*b* can be adjusted in position also in the sliding direction.

The connecting plate 103 is constituted by a steel board 103*a*. Position adjusting holes 103*d* are formed in the board 103*a* of the connecting plate 103 at locations corresponding to the position adjusting bolts 101*d*. The position adjusting holes 103 dare through holes. The position adjusting bolts 101*d* are fitted into the position adjusting holes 103*d*, and are used for fastening the connecting plate 103 to the carrier body 101 through the adjusting plate 102. Fastening nuts 104 are used for fastening the connecting plate 103 to the carrier body 101. The fastening nuts 104 also function as parts which constitute the positioning unit 100. More specifically, the fastening nuts 104 are threadably engaged with the position adjusting bolts 101*d* which pass through the position adjusting holes 102*d* and 103*d*, so that the adjusting plate 102 and the connecting plate 103 are mounted on the carrier body 101. The connecting plate 103 is formed into a wing shape extending laterally from the center portion. Attaching holes 103*e* are formed in opposite ends of the connecting plate 103, respectively, and the holders 20 (see FIG. 4) are attached to the attaching holes 103*e*.

Figure 5:
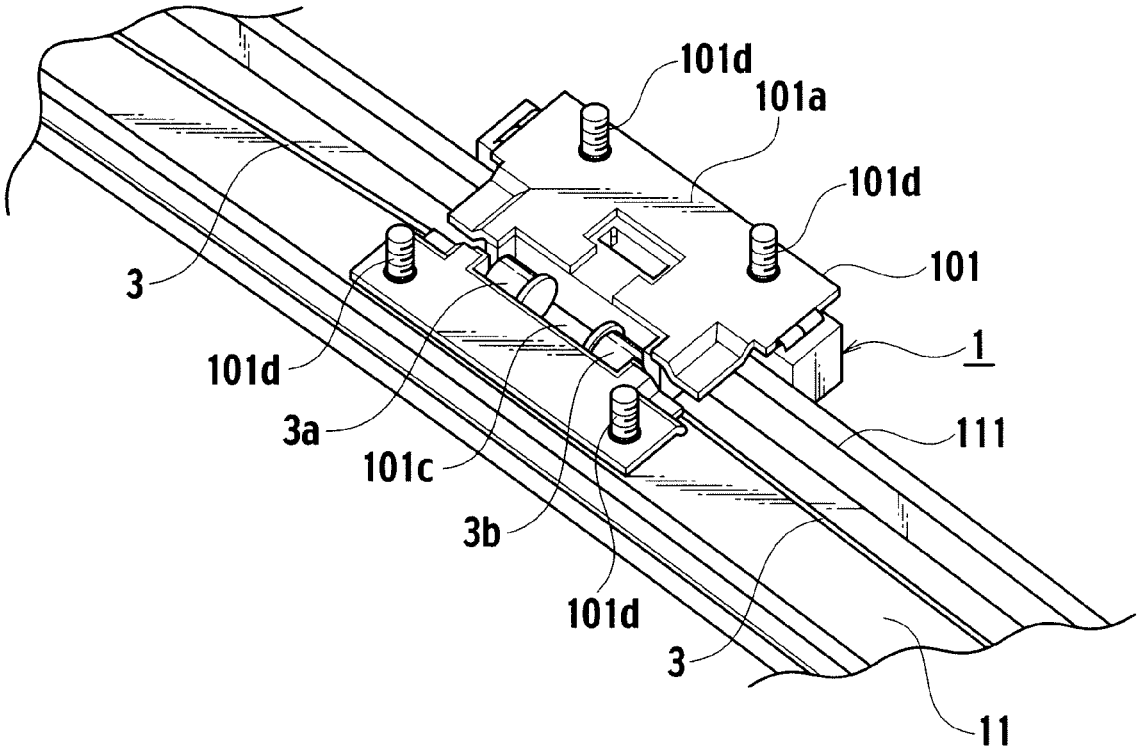
FIG. 5 is a perspective view of relevant parts of the window regulator shown in FIG. 1.

As shown in FIG. 5, the window regulator 1 has the accommodation recess 101*c* in the central portion of the carrier body 101 of the carrier member 10 on the opposite side from a side where the guide rail 11 is attached. One end terminal member 3*a* and the other end terminal member 3*b* of the wire 3 for sliding the carrier member 10 are accommodated in the accommodation recess 101*c* on the guide rail 11. The accommodation recess 101*c* is covered with the connecting plate 103 through the adjusting plate 102 (directly covered with the connecting plate 103 when there is no adjusting plate 102) in a state where the opposite end terminal members 3*a* and 3*b* of the wire 3 are accommodated. The state where the opposite end terminal members 3*a* and 3*b* of the wire 3 are accommodated is maintained by the connecting plate 103.

An assembling method of the window regulator 1 is explained next with reference to FIGS. 1 to 3. First, the carrier body 101 is mounted on the guide rail 11, and the first sliding elements 101*b* of the carrier body 101 is slidably brought into contact with one surface of the vertical wall 111 of the guide rail 11. In this state, the positioning unit 100 is used. That is, the position adjusting bolts 101*d* of the carrier body 101 are fitted into the position adjusting holes 102*d* of the adjusting plate 102, and the adjusting plate 102 is assembled onto the carrier body 101. In the state where the adjusting plate 102 is superposed on the carrier body 101, an assembling device (not shown) is used so that the first sliding elements 101*b* of the carrier body 101 are pressed against one of the surfaces of the vertical wall 111 of the guide rail 11, and this state is maintained.

The assembling device (not shown) is used so that the second sliding elements 102*b* of the adjusting plate 102 come into contact with the other surface of the vertical wall 111 of the guide rail 11 while the second sliding elements 102*b* slide, and a predetermined load is applied to press the second sliding elements 102*b* against the other surface of the vertical wall 111. In this state, the position adjusting bolts 101*d* of the carrier body 101 are fitted into the position adjusting holes 103*d* of the connecting plate 103, and the position adjusting bolts 101*d* are fitted into the fastening nuts 104. In a state where the connecting plate 103 is superposed on the carrier body 101 through the adjusting plate 102, the position adjusting bolts 101*d* are threadably engaged with the fastening nuts 104 and fastened thereto. When the series of operations are finished, the assembling of the carrier member 101 is completed. The assembling device includes a first push rod for the first sliding element 101*b*, a second push rod for the second sliding element 102*b*, a first air cylinder for driving the first push rod, and a second cylinder for driving the second push rod, for example. The first push rod driven by the first air cylinder presses the first sliding element 101*b* against the one surface of the vertical wall 111 of the guide rail 11, and the second push rod driven by the second air cylinder presses the second sliding element 102*b* against the other surface of the vertical wall 111 of the guide rail 11.

In this state, in the carrier member 10, the positioning unit 100 presses the first sliding elements 101*b* and the second sliding elements 102*b* against the guide rail 11, and in a state where the guide rail 11 is sandwiched between the first sliding elements 101*b* and the second sliding elements 102*b*, the first sliding elements 101*b* and the second sliding elements 102*b* are relatively positioned. That is, the vertical wall 111 of the guide rail 11 is located between the first sliding elements 101*b* and the second sliding elements 102*b* with a gap of "zero" therebetween. The window regulator 1 is mounted on the door, and the window panel 2 is attached to the carrier member 10 of the window regulator 1.

According to the window regulator 1 having the structure above described and its assembling method, the carrier body 101 is mounted on the guide rail 11 in the assembling stage, the terminal members 3*a* and 3*b* of the wire 3 are attached and accommodated in the accommodation recess 101*c*, and in this state, the connecting plate 103 covers the accommodation recess 101*c* through the adjusting plate 102. Therefore, when the terminal members 3*a* and 3*b* are attached and accommodated, the guide rail 11 does not become an obstacle, and the assembling efficiency can be enhanced.

As explained above, in the window regulator 1 according to the first embodiment, because the carrier member 10 can be assembled onto the guide rail 11 with the gap of "zero", it is possible to prevent the window panel 2 from rattling. As a result, the quality of the window regulator 1 can be enhanced. The positioning unit 100 is not a complicated part, and a conventional part can be used as the positioning unit 100 only by slightly modifying its shape. Therefore, it is possible to provide a window regulator 1 that causes reduced rattles and can be produced at a lower cost.

According to the first embodiment, the window regulator includes the positioning unit 100, and it is possible to cause the pairs of sliding elements (first sliding elements 101*b* and second sliding elements 102*b*) to sandwich the guide rail 11 in a state where they press the guide rail 11. Therefore, it is possible to provide the window regulator 1 in which there is no play between the guide rail 11 and the carrier member 10, and rattles of the sliding portion therebetween can be reduced.

According to the first embodiment, because the carrier member 10 includes the three parts, i.e., the connecting plate 103, the adjusting plate 102, and the carrier body 101, it is possible to provide the window regulator 1 in which the rigidity of the carrier member 10 is enhanced, and the rattles between the guide rail 11 and the carrier member 10 can further be reduced.

According to the first embodiment, the positioning unit 100 relatively positions the pairs of sliding elements (first sliding elements 101*b* and second sliding elements 102*b*) in a state where they are pressed against the guide rail 11 by the assembling device and they sandwich the guide rail 11. Therefore, the pair of sliding elements (first sliding elements 101*b* and second sliding elements 102*b*) can easily be positioned.

According to the first embodiment, the window regulator includes the accommodation recess 101*c* having the opening in the carrier body 101 of the carrier member 10 on the side of the connecting plate 103. Therefore, in the assembling stage, the terminal members 3*a* and 3*b* of the wire 3 are attached after the carrier body 101 is mounted on the guide rail 11, and in the state where the terminal members 3*a* and 3*b* are attached, the accommodation recess 101*c* can be covered with the connecting plate 103, and the assembling efficiency can be enhanced.

Second Embodiment

A second embodiment of the present invention describes an example in which the structure of the window regulator 1 according to the first embodiment is simplified.

Figure 6:
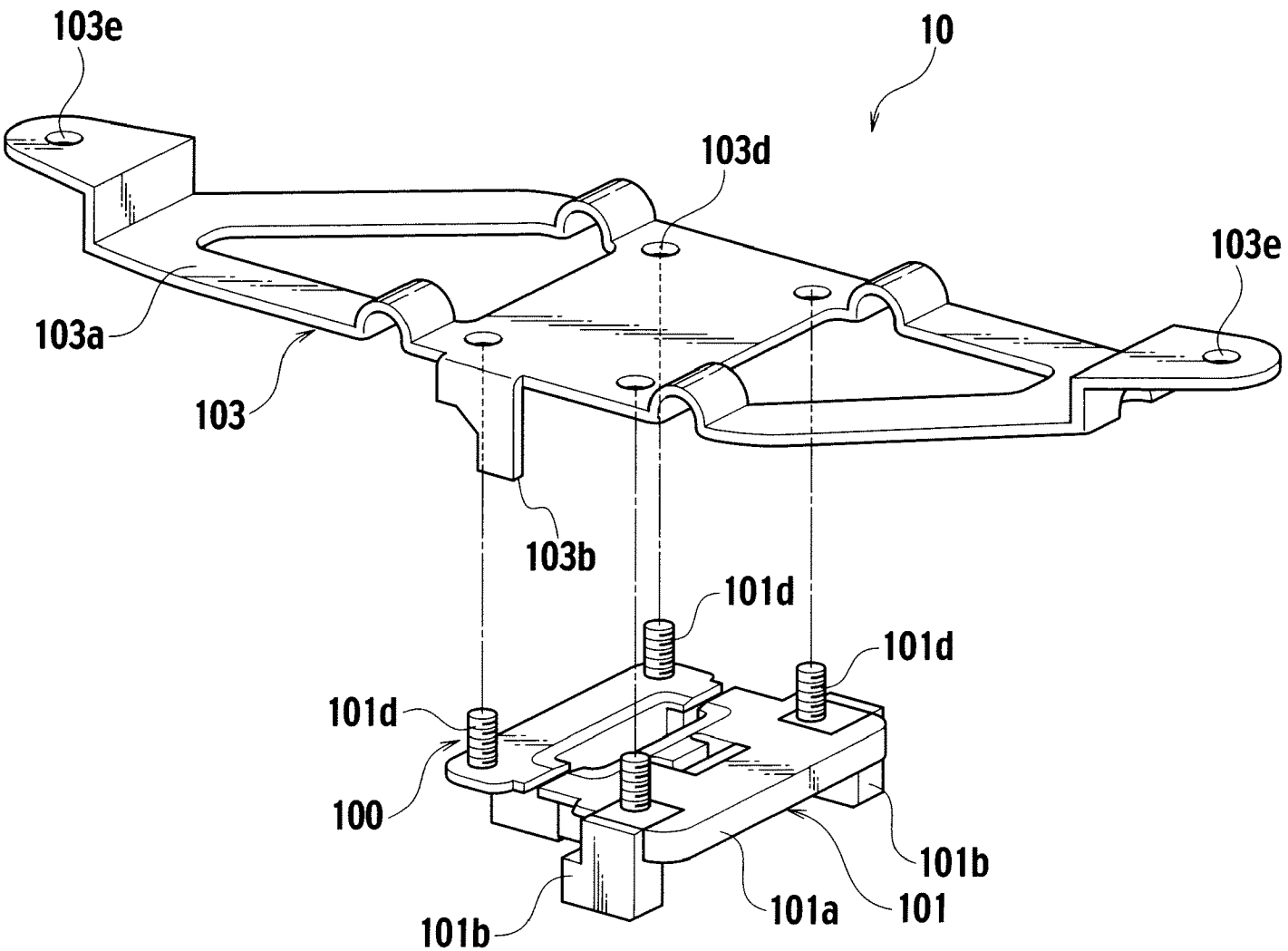
FIG. 6 is a perspective view of relevant parts of a window regulator according to a second embodiment of the present invention.

As shown in FIG. 6, in the window regulator 1 according to the second embodiment, the carrier member 10 includes the connecting plate 103 having second sliding elements 103*b* fixed, and the carrier body 101 which is connected to the connecting plate 103 and has the first sliding elements 101*b* fixed. That is, in the carrier member 10 of the window regulator 1 according to the second embodiment, the adjusting plate 102 of the carrier member 10 of the window regulator 1 according to the first embodiment is omitted, and the connecting plate 103 is provided with the second sliding elements 103*b*, instead of the second sliding elements 102*b* of the adjusting plate 102.

The positioning unit 100 includes the position adjusting bolts 101*d* provided on the carrier body 101, the position adjusting holes 103*d* which are provided on the connecting plate 103, into which the position adjusting bolts 101*d* are inserted, and in which the connecting plate 103 can move toward the guide rail 11 with respect to the inserted position adjusting bolts 101*d*, and the fastening nuts 104 (see FIG. 1) which fasten the position adjusting bolts 101*d* through the position adjusting holes 103*d* and which mount the connecting plate 103 on the carrier body 101. The assembling method of the window regulator 1 is basically the same as that of the window regulator 1 according to the first embodiment, except that the adjusting plate 102 explained in the first embodiment is not mounted.

In the second embodiment, in addition to the effect obtained by the window regulator 1 according to the first embodiment, because the carrier member 10 has the two parts, i.e., the connecting plate 103 and the carrier body 101, the number of parts of the carrier member 10 is reduced, and the window regulator 1 having the simple structure can be provided.

Third Embodiment

A third embodiment of the present invention describes an example in which the assembling method of the window regulator 1 according to the first embodiment is simplified.

Figure 7:
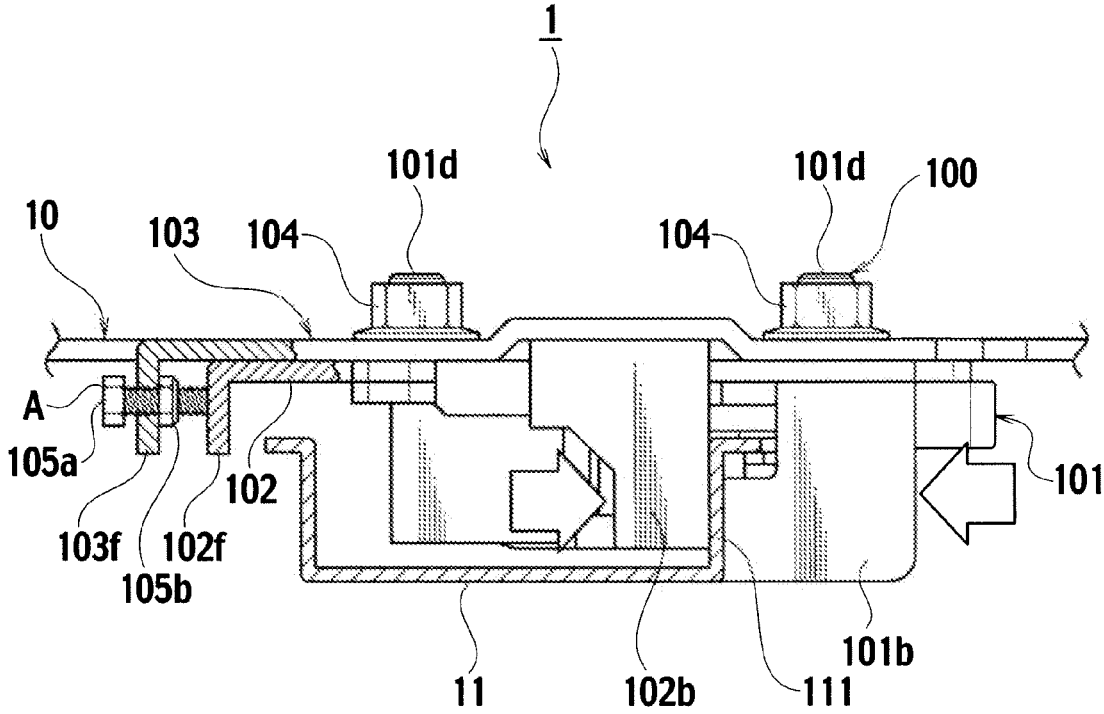
FIG. 7 is a sectional view of relevant parts of a window regulator according to a third embodiment of the present invention.
Figure 9:
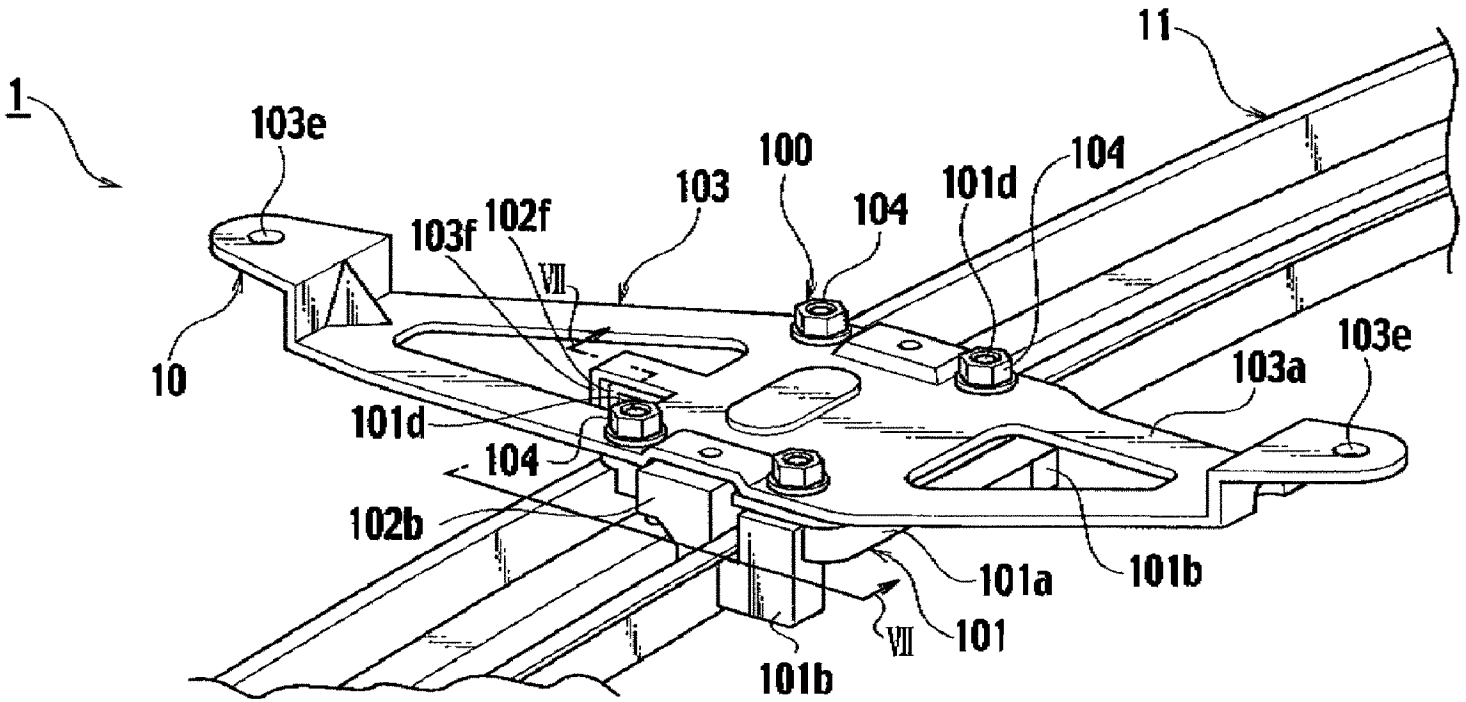
FIG. 9 is a perspective view of the relevant parts of the window regulator shown in FIG. 7.

As shown in FIG. 7, in the window regulator 1 according to the third embodiment, the positioning unit 100 according to the first embodiment further includes a screw-type pressing mechanism A. The screw-type pressing mechanism A moves the second sliding element 102*b* toward the first sliding element 101*b*, and presses the second sliding element 102*b* against the vertical wall 111 of the guide rail 11. FIG. 9 is a perspective view of the relevant parts of the window regulator shown in FIG. 7.

More specifically, the screw-type pressing mechanism A includes a flange 102*f* formed on the adjusting plate 102, a flange 103*f* formed on the connecting plate 103, a bolt 105*a* which is attached to the flange 103*f* to slide the flange 102*f*, and a nut 105*b* which fixes the fastening position of the bolt 105*a*. The flanges 102*f* and 103*f* are arranged at locations opposed to the vertical wall 111 of the guide rail 11, and the bolt 105*a* pushes the flange 102*f* by screwing the bolt 105*a*, to cause the adjusting plate 102 to slide toward the vertical wall 111 with respect to the connecting plate 103. In the assembling stage of the window regulator 1, when the screw-type pressing mechanism A is used, it becomes unnecessary to use the assembling device.

In the third embodiment, in addition to the effect obtained by the window regulator 1 according to the first embodiment, the positioning unit 100 can move the first sliding element 101*b* toward the second sliding element 102*b* by the screw-type pressing mechanism A, and the first sliding element 101*b* which is one of the pair of sliding elements can be pressed against the vertical wall 111 of the guide rail 11. Therefore, it is possible to easily position the first sliding element 101*b* and the second sliding element 102*b*. The positioning unit 100 according to the third embodiment can be applied as the positioning unit 100 according to the second embodiment.

Fourth Embodiment

A fourth embodiment of the present invention describes an example in which the assembling method of the window regulator 1 according to the third embodiment is changed.

Figure 8:
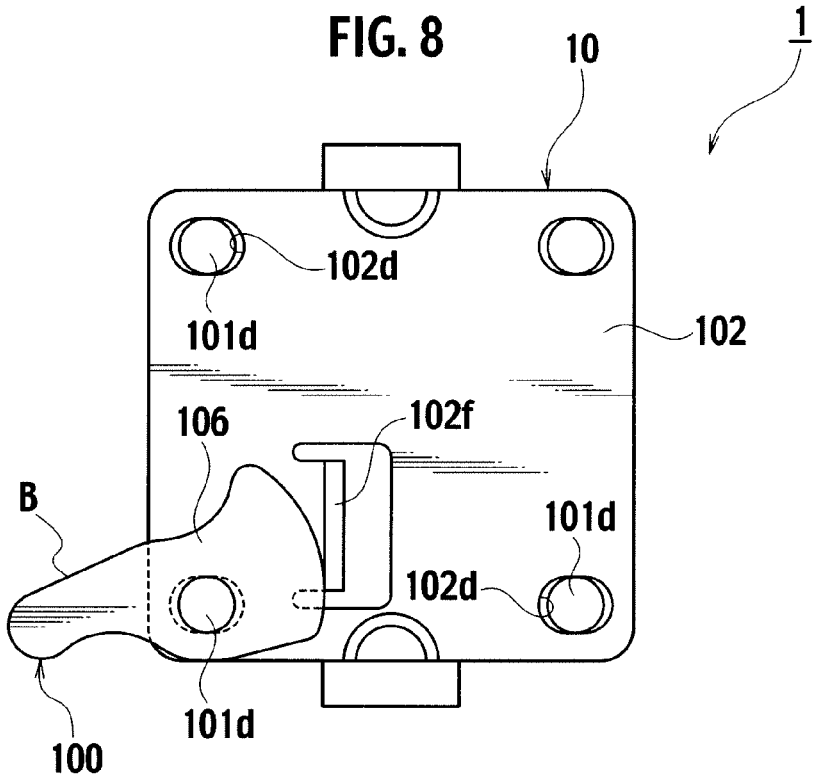
FIG. 8 is a plan view of relevant parts of a window regulator according to a fourth embodiment of the present invention.

As shown in FIG. 8, in the window regulator 1 according to the fourth embodiment, the positioning unit 100 according to the first embodiment further includes an eccentric cam-type pressing mechanism B. The eccentric cam-type pressing mechanism B moves the second sliding element 102*b* toward the first sliding element 101*b* to press the second sliding element 102*b* against the vertical wall 111 of the guide rail 11.

More specifically, the eccentric cam-type pressing mechanism B includes a flange 102*f* formed on the adjusting plate 102, and an eccentric cam 106 which rotates around the position adjusting bolt 101*d* embedded in the carrier body 101 and which pushes the flange 102*f* against the guide rail 11 according to the rotation. In the assembling stage of the window regulator 1, the carrier body 101, the adjusting plate 102, and the connecting plate 103 are fastened in a state where the eccentric cam 106 is operated to press the second sliding element 102*b* of the adjusting plate 102 against the guide rail 11. In the assembling stage of the window regulator 1, when the eccentric cam-type pressing mechanism B is used, it is unnecessary to use the assembling device.

In the fourth embodiment, in addition to the effect obtained by the window regulator 1 according to the first embodiment, the eccentric cam-type pressing mechanism B can move the first sliding element 101*b* toward the second sliding element 102*b* to press the first sliding element 101*b* which is one of the pair of sliding elements against the vertical wall 111 of the guide rail 11. Therefore, it is possible to easily position the first sliding element 101*b* and the second sliding element 102*b*. The positioning unit 100 according to the fourth embodiment can be applied as the positioning unit 100 according to the second embodiment.

Other Embodiments

The present invention is not limited to the embodiments described above. For example, the number of first sliding elements 101*b* and the second sliding elements 102*b* are not limited. Although the window regulator 1 includes the two first sliding elements 101*b* and the two second sliding elements 102*b* in the above embodiments, the window regulator 1 may include two first sliding elements 101*b*, and one second sliding element 102*b* located therebetween, or two second sliding elements 102*b*, and one first sliding element 101*b* located therebetween.

What is claimed is:

1. A window regulator comprising:

a carrier member to which a window panel is attached;

a pair of sliding elements which are provided on the carrier member, which sandwich a guide rail, and which can slide on the guide rail; and a positioning unit which relatively positions the pair of sliding elements in a state where the pair of sliding elements press the guide rail and the pair of sliding elements sandwich the guide rail, wherein:

the carrier member includes a connecting plate to which the window panel is attached, a carrier body which is connected to the connecting plate and to which one of the pair of sliding elements is fixed, and an adjusting plate which is located between the connecting plate and the carrier body and to which an other of the pair of sliding elements is fixed, and the positioning unit includes a position adjusting bolt provided on the carrier body, a position adjusting hole which is formed in the adjusting plate, into which the position adjusting bolt is inserted, and in which the adjusting plate can move toward the guide rail with respect to the inserted position adjusting bolt, and a nut which is threadably engaged with the position adjusting bolt passing through the position adjusting hole, and which mounts the adjusting plate on the carrier body.

2. The window regulator according to claim 1, wherein the positioning unit relatively positions the pair of sliding elements in a state where the sliding elements are pressed against the guide rail by an assembling device and the sliding elements sandwich the guide rail.

3. The window regulator according to claim 1, wherein the positioning unit includes a pressing mechanism which presses one of the pair of sliding elements against the guide rail by a screw.

4. The window regulator according to claim 1, wherein the positioning unit includes a pressing mechanism which presses one of the pair of sliding elements against the guide rail by an eccentric cam.

5. The window regulator according to claim 1, wherein:

the carrier body has an accommodation recess formed on an opposite side from a location where the guide rail is attached, and the connecting plate covers the accommodation recess in a state where corresponding terminal members of opposite ends of a wire for moving the carrier member along the guide rail are accommodated in the accommodation recess to maintain the accommodation.

6. A window regulator comprising:

a carrier member to which a window panel is attached;

a pair of sliding elements which are provided on the carrier member, which sandwich a guide rail, and which can slide on the guide rail; and a positioning unit which relatively positions the pair of sliding elements in a state where the pair of sliding elements press the guide rail and the pair of sliding elements sandwich the guide rail, wherein:

the carrier member includes a connecting plate to which the window panel is attached and to which one of the pair of sliding elements is fixed, and a carrier body which is connected to the connecting plate and to which an other of the pair of sliding elements is fixed, and the positioning unit includes a position adjusting bolt provided on the carrier body, a position adjusting hole which is formed in the connecting plate, into which the position adjusting bolt is inserted, and in which the connecting plate can move toward the guide rail with respect to the position adjusting bolt as inserted, and a nut which is threadably engaged with the position adjusting bolt passing through the position adjusting hole, and which mounts the connecting plate on the carrier body.

7. The window regulator according to claim 6, wherein the positioning unit relatively positions the pair of sliding elements in a state where the sliding elements are pressed against the guide rail by an assembling device and the sliding elements sandwich the guide rail.

8. The window regulator according to claim 6, wherein the positioning unit includes a pressing mechanism which presses one of the pair of sliding elements against the guide rail by use of a screw.

9. The window regulator according to claim 6, wherein the positioning unit includes a pressing mechanism which presses one of the pair of sliding elements against the guide rail by use of an eccentric cam.

10. The window regulator according to claim 6, wherein:

the carrier body has an accommodation recess formed on an opposite side from a location where the guide rail is attached, and the connecting plate covers the accommodation recess in a state where corresponding terminal members of opposite ends of a wire for moving the carrier member along the guide rail are accommodated in the accommodation recess to maintain the accommodation.

* * * * *